US009057199B2

(12) United States Patent
Gillman

(10) Patent No.: US 9,057,199 B2
(45) Date of Patent: Jun. 16, 2015

(54) STRUCTURAL INSULATED BUILDING PANEL WITH A MOISTURE BARRIER SEAL

(71) Applicant: Jerry Gillman, Miami, FL (US)

(72) Inventor: Jerry Gillman, Miami, FL (US)

( * ) Notice: Subject to any disclaimer, the term of this patent is extended or adjusted under 35 U.S.C. 154(b) by 0 days.

(21) Appl. No.: 14/195,255

(22) Filed: Mar. 3, 2014

(65) Prior Publication Data

US 2014/0250812 A1 Sep. 11, 2014

Related U.S. Application Data

(60) Provisional application No. 61/773,475, filed on Mar. 6, 2013, provisional application No. 61/773,489, filed on Mar. 6, 2013.

(51) Int. Cl.

| | |
|---|---|
| ***E04C 2/38*** | (2006.01) |
| ***E04C 2/284*** | (2006.01) |
| ***E04B 1/66*** | (2006.01) |
| ***E04F 13/08*** | (2006.01) |
| ***E04F 13/14*** | (2006.01) |

(52) U.S. Cl.

CPC ..... *E04F 13/0866* (2013.01); *E04F 13/0894* (2013.01); *E04F 13/0898* (2013.01); *E04F 13/0878* (2013.01); *E04F 13/14* (2013.01)

(58) Field of Classification Search

CPC ... E04F 13/0866; E04F 13/14; E04F 13/0878; E04F 13/0898; E04F 13/0894

USPC ..... 52/782.1, 309.3, 309.8–309.15, 585.1, 52/582.1, 582.2, 584.1, 588.1, 376, 417, 52/464, 586.2; 403/359

See application file for complete search history.

(56) References Cited

U.S. PATENT DOCUMENTS

| | | | | |
|---|---|---|---|---|
| 3,264,649 | A * | 8/1966 | White | 343/915 |
| 3,557,503 | A * | 1/1971 | Snyder | 52/309.11 |
| 5,589,243 | A * | 12/1996 | Day | 428/56 |
| 5,950,389 | A * | 9/1999 | Porter | 52/586.1 |
| 8,733,046 | B2 * | 5/2014 | Naidoo | 52/309.4 |
| 2011/0147358 | A1 * | 6/2011 | Kober et al. | 219/202 |

* cited by examiner

*Primary Examiner* — Jeanette E Chapman

(57) ABSTRACT

A structural insulated building panel with a moisture barrier seal includes a structural insulated panel, a seal section, a first spline-receiving grove, and a second spline-receiving groove. The seal section is extended from a phenolic resin sheet of the structural insulated panel so that the seal section can be positioned in between multiple structural insulated panels in order to prevent moisture penetration. The seal section is adjacently positioned with the second spline-receiving groove of the initial structural insulated panel and extends into the first spline-receiving groove of the adjacent structural insulated panel during the installation of multiple structural insulated panels.

15 Claims, 11 Drawing Sheets

STRUCTURAL INSULATED BUILDING PANEL WITH A MOISTURE BARRIER SEAL

The current application claims a priority to the U.S. Provisional Patent application Ser. No. 61/773,475 filed on Mar. 6, 2013 and the U.S. Provisional Patent application Ser. No. 61/773,489 filed on Mar. 6, 2013.

FIELD OF THE INVENTION

The present invention relates generally to an apparatus for forming watertight seals in between structural insulated panels. More specifically, the present invention is an overlapping section of phenolic resin sheet that is used to form a watertight seal in the connection of exterior structural insulated panels.

BACKGROUND OF THE INVENTION

Structural insulated panels are composite building material of an insulating layer of rigid polymer foam sandwiched between two layers of structural board. These structural boards can consist of material such as sheet metal, plywood, particle board, etc. while the insulating layer of rigid polymer foam is commonly expanded polystyrene foam, extruded polystyrene foam, polyisocyanurate foam, or polyurethane foam. The structural insulated panels can be used within many different construction applications, such as exterior walls, interior walls, roofs, floors, and foundation systems since the structural insulated panels combine the functionality of the conventional building components, such as studs, joists, insulation, vapor barrier, and air barrier. The drawbacks of the structural insulated panel building is that the connection joints of the exterior structural insulated panels create thermal breaks and tend to be a cause of moisture intrusion into the structure. Moisture can penetrate into the structural through capillary action created by a thermal break in the structure as well as penetrate any areas not properly sealed. Even though Caulking and placing moisture barrier materials over the connection joints have been implemented as solutions, these solutions don't provide a permanent solution for the actual problem.

It is therefore an object of the present invention to provide a structural insulated building panel with a moisture barrier seal, where the moisture barrier seal provides an extra layer of protection against the moisture penetrating problem. The moisture barrier seal extends from one structural insulated panel into the prefabricated slot of the adjacent structural insulated panel providing an impervious moisture barrier seal at the panel joint. Due to the proper placement of the moisture barrier seal, the present invention provides a permanent solution for the moisture penetration problem of the structural insulated panel buildings and greatly reduces the thermal break issue that can occur at the joints of structural insulated panels. Thermal break moisture intrusion tends to be an issue in cold weather conditions with heated structures and or hot weather conditions with air conditioning and or cold room construction.

DETAIL DESCRIPTIONS OF THE INVENTION

Figure 1:
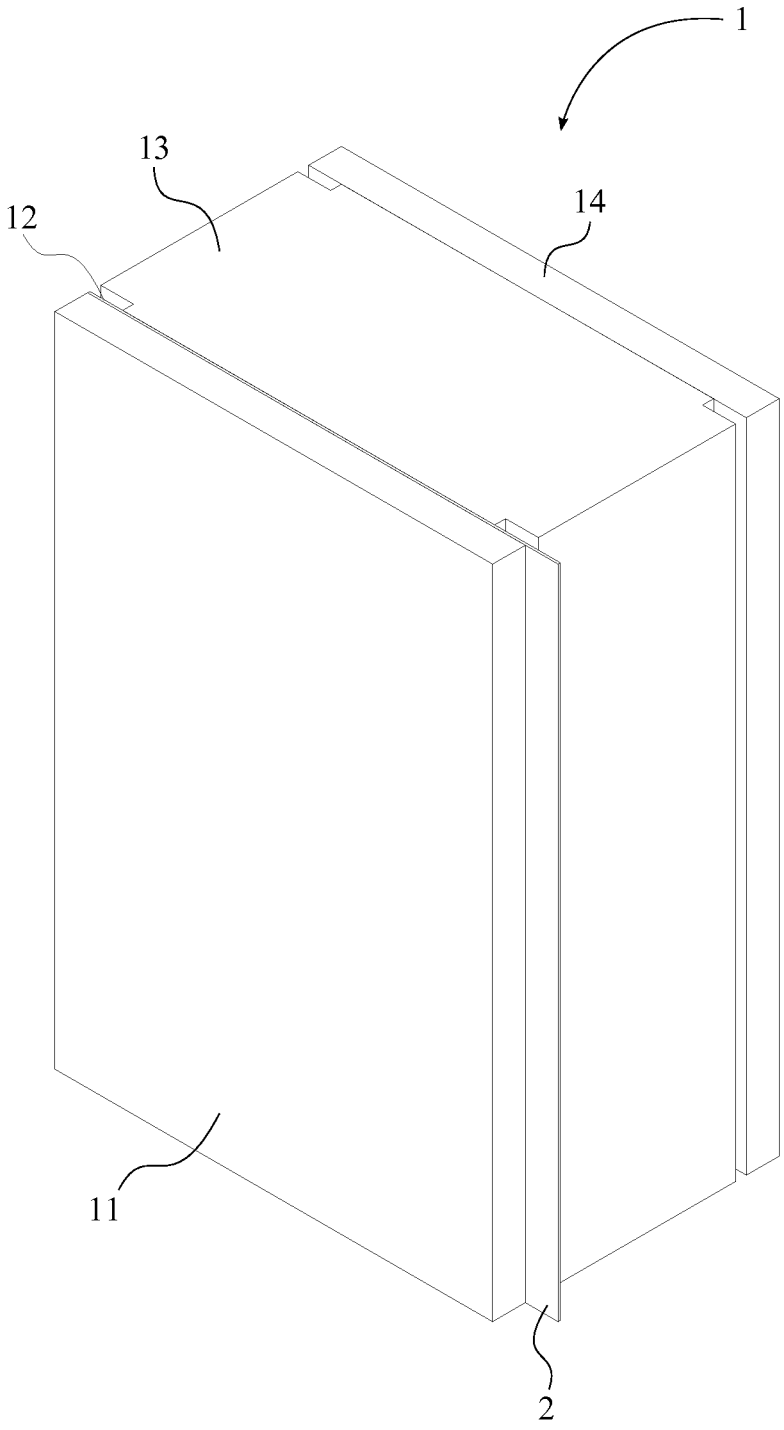
FIG. 1 is a perspective view of the present invention.

All illustrations of the drawings are for the purpose of describing selected versions of the present invention and are not intended to limit the scope of the present invention.

The present invention is a structural insulated building panel with a moisture barrier seal that replaces the conventional load bearing building panel of the building construction industry. The present invention is preferably used for constructing of the exterior walls of a building structure; however, the present invention can be used to construct other structural systems such as floors and interior walls. The present invention comprises a structural insulated panel 1, a seal section 2, a first spline-receiving groove 3, and a second spline-receiving groove 4. The seal section 2 is extended from a phenolic resin sheet 12 of the structural insulated panel 1 so that the seal section 2 can function as a barrier in between multiple structural insulated panels 1 to stop the penetration of moisture. The first spline-receiving groove 3 and the second spline-receiving groove 4 are traversed into the structural insulated panel 1 in such way that the first spline-receiving groove 3 and the second spline-receiving groove 4 are adjacently positioned with the phenolic resin sheet 12, where the first spline-receiving groove 3 and the second spline-receiving groove 4 are oppositely positioned across the structural insulated panel 1.

The structural insulated panel 1 further comprises an exterior surface board 11, an expanded polystyrene layer 13, and an interior surface board 14. In reference to FIG. 1-FIG. 4, the phenolic resin sheet 12 is adjacently laminated with the expanded polystyrene layer 13 as the phenolic resin sheet 12 improves the fire resistance within the present invention while providing superior impact absorbance to the present invention. The phenolic resin sheet 12 is a lightweight, chemical resistance material, wherein those materialistic properties of the phenolic resin sheet 12 improve the overall functionality of the present invention. The phenolic resin sheet 12 also acts as a thermal barrier for the present invention, where the phenolic resin sheet 12 does not burn and is heat resistant, thereby providing a thermal barrier at the panel joints blocking moisture and heat transfer. The expanded polystyrene layer 13 is a thermoplastic, closed-cell, lightweight, and rigid-foam material, where the expanded polystyrene layer 13 provides low thermal conductivity, high compressive strength, and shock absorbing properties to the present invention. The exterior surface board 11 is adjacently laminated to the phenolic resin sheet 12 in such way that the exterior surface board 11 is oppositely positioned from the expanded polystyrene layer 13. The interior surface board 14 is adjacently laminated to the expanded polystyrene layer 13, where the interior surface board 14 is oppositely positioned from the phenolic resin sheet 12. The exterior surface board 11 and the interior surface board 14 provide high strength, fire resistance, mold and mildew control, and sound control functionality to the present invention. In reference to general structural construction, the exterior surface board 11 is generally aligned as the exterior wall surface of the structural building while the interior surface board 14 is generally aligned as the interior wall surface of the structural building. Once the exterior surface board 11, the phenolic resin sheet 12, the expanded polystyrene layer 13, and the interior surface board 14 are securely laminated with each other, the exterior surface board 11, the phenolic resin sheet 12, the expanded polystyrene layer 13, and the interior surface board 14 are able to from a single rigid panel. Even though the present invention uses laminating as the preferred connection method, the present invention can utilize any other type of connection methods or any other type adhesive materials, such as high pressure bonding, mechanical fasteners, and adhesive, to connect the exterior surface board 11, the phenolic resin sheet 12, the expanded polystyrene layer 13, and the interior surface board 14 together.

In the preferred embodiment of the present invention, a pair of magnesium oxide boards is used as the exterior surface board 11 and the interior surface board 14. Since the exterior surface board 11 and the phenolic resin sheet 12 are laminated to each other, the phenolic resin sheet 12 converts the brittleness of the magnesium oxide board into high impact panel so that the present invention is able to withstand high impact forces and high stress forces. In other words, the exterior surface board 11 and the phenolic resin sheet 12 form a non-brittle outer layer within the present invention.

In reference to FIG. 1-FIG. 4, the exterior surface board 11, the phenolic resin sheet 12, the expanded polystyrene layer 13, and the interior surface board 14 each comprise a first edge 15 and a second edge 16. More specifically, the first edge 15 of the exterior surface board 11, the phenolic resin sheet 12, the expanded polystyrene layer 13, and the interior surface board 14 are oppositely positioned from the second edge 16 of the exterior surface board 11, the phenolic resin sheet 12, the expanded polystyrene layer 13, and the interior surface board 14. The first edge 15 of the exterior surface board 11, the phenolic resin sheet 12, the expanded polystyrene layer 13, and the interior surface board 14 are coincidentally positioned with each other so that the all of the first edges 15 are able to create a flat surface within the present invention. Similarly, the second edge 16 of the exterior surface board 11, the expanded polystyrene layer 13, and the interior surface board 14 are coincidentally positioned with each other; however, the second edge 16 of the phenolic resin sheet 12 is extended from the second edge 16 of the exterior surface board 11, the expanded polystyrene layer 13, and the interior surface board 14 so that the seal section 2 can be formed within the present invention.

Figure 2:
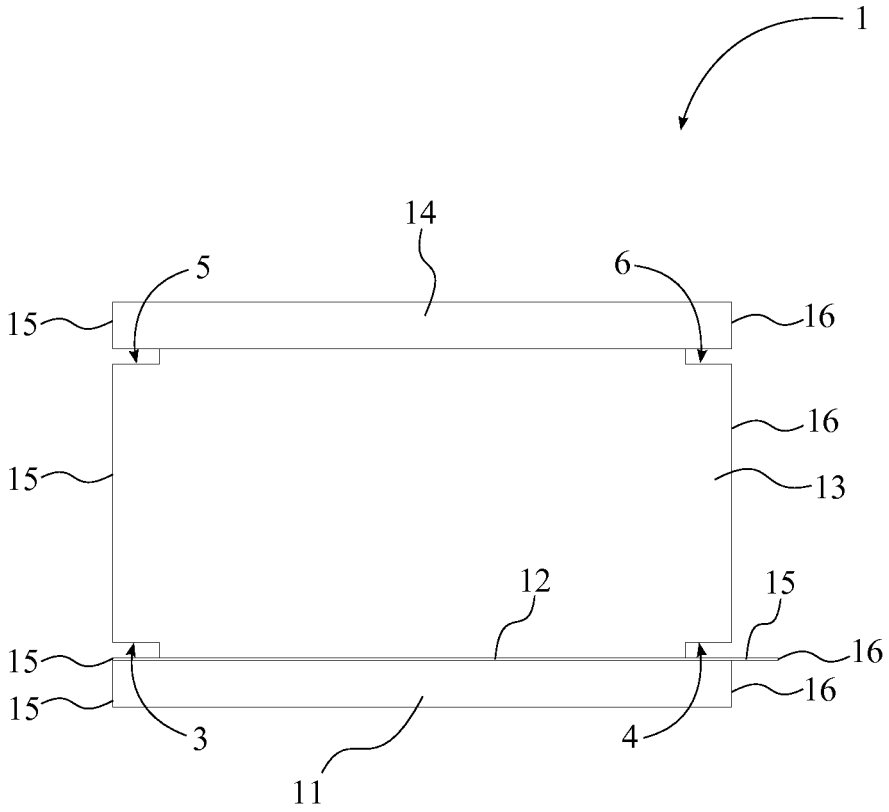
FIG. 2 is a top view of the present invention.
Figure 3:
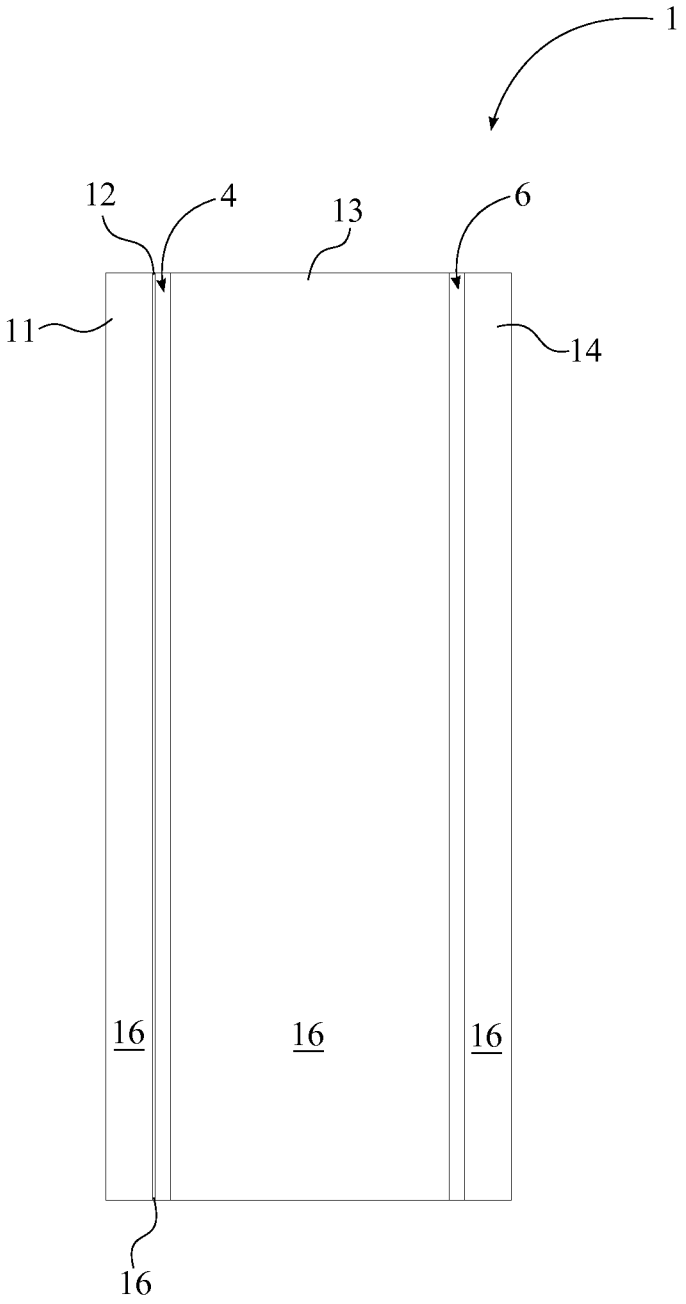
FIG. 3 is a first side view of the present invention.
Figure 4:
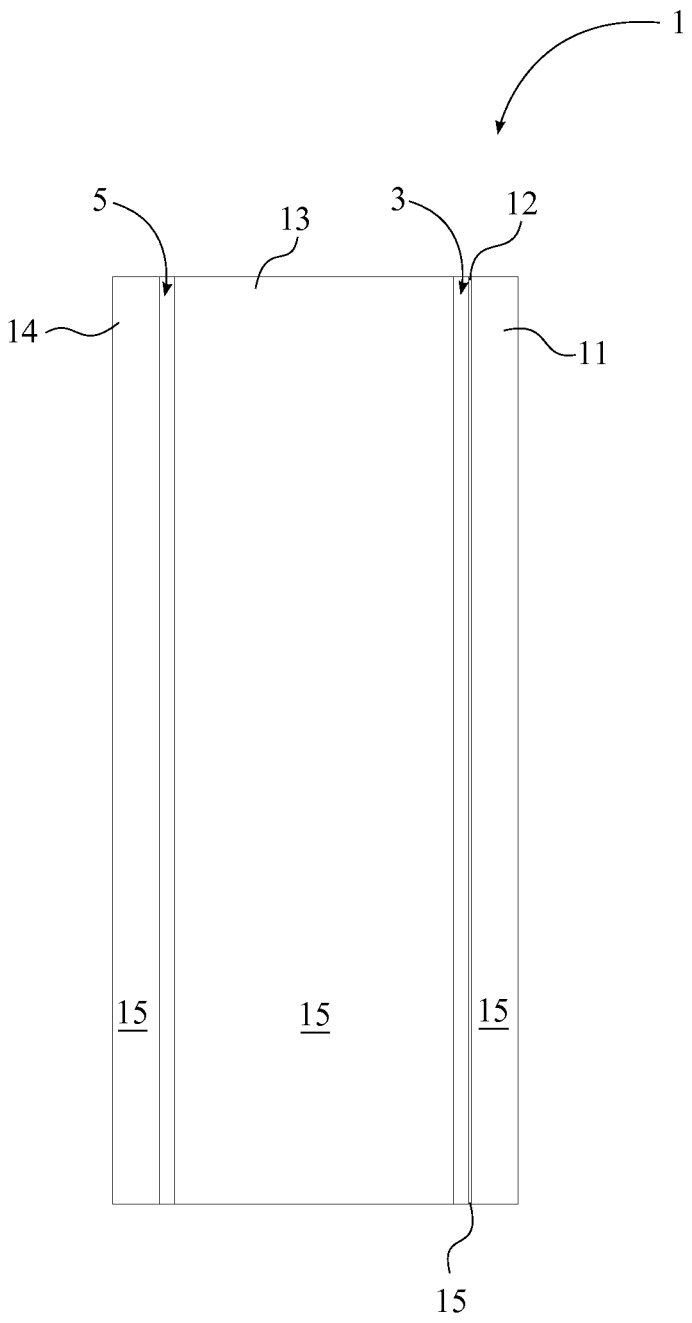
FIG. 4 is a second side view of the present invention.
Figure 5:
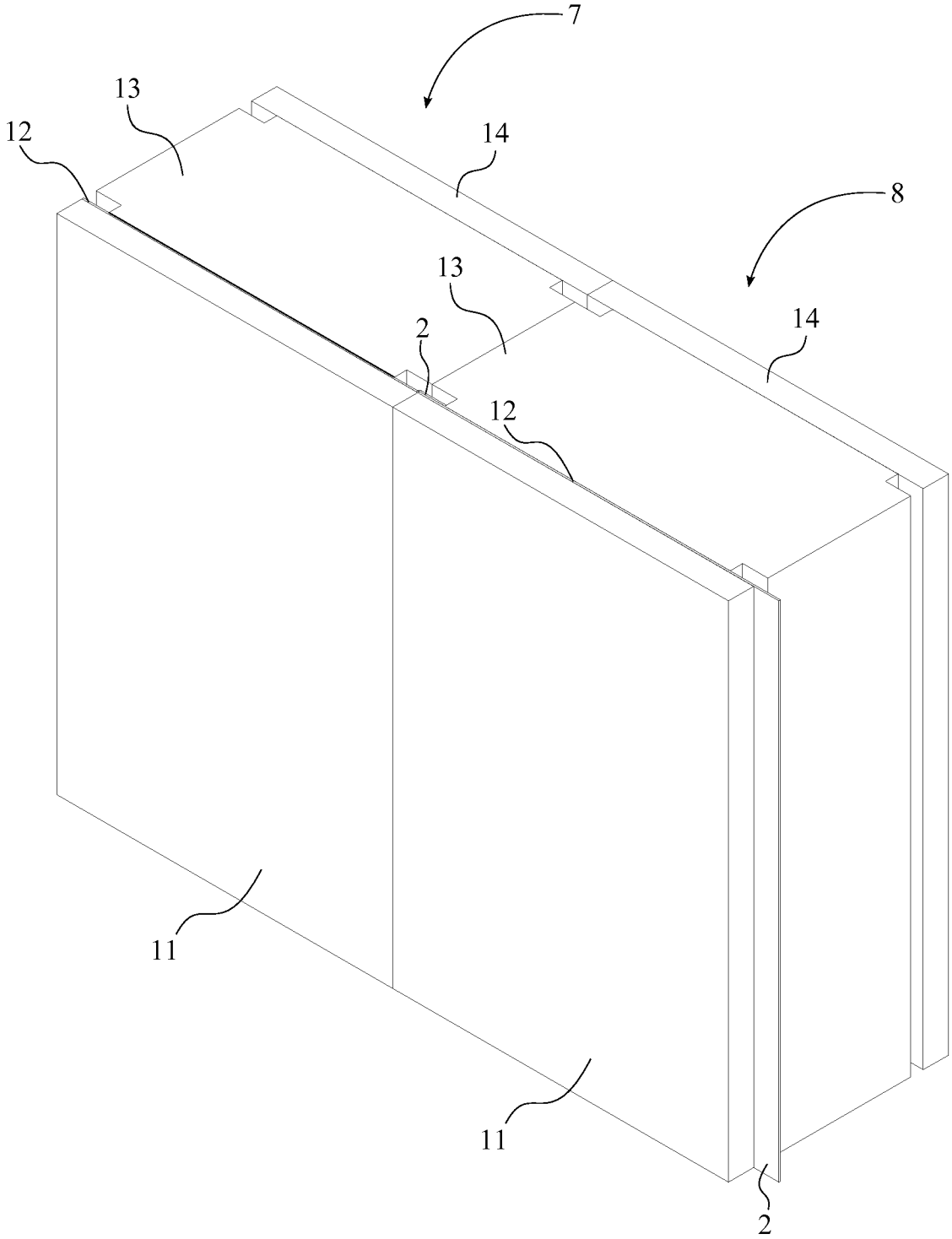
FIG. 5 is a perspective view of the present invention, wherein two structural insulated panels are positioned adjacent to each other.
Figure 6:
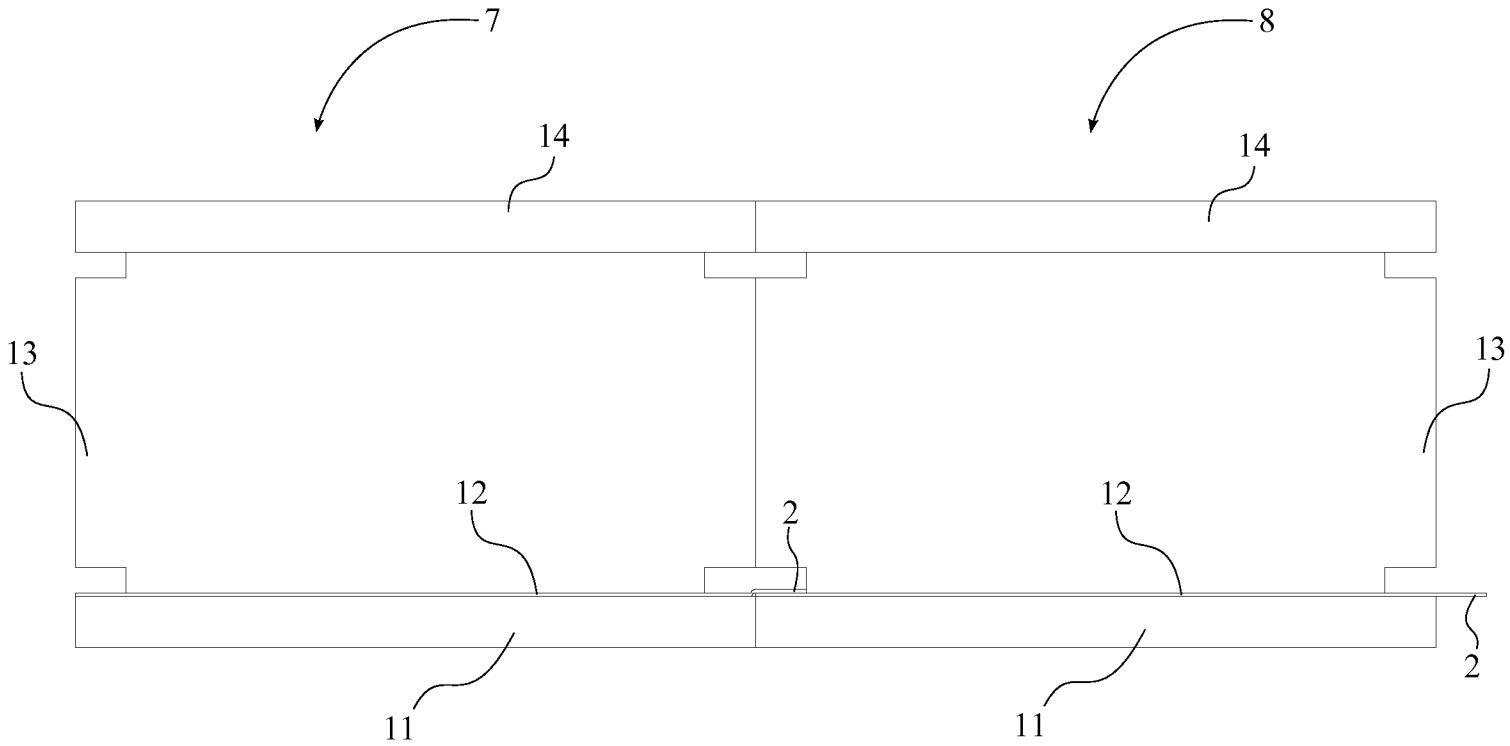
FIG. 6 is a top view of the present invention, wherein the two structural insulated panels are positioned adjacent to each other.
Figure 7:
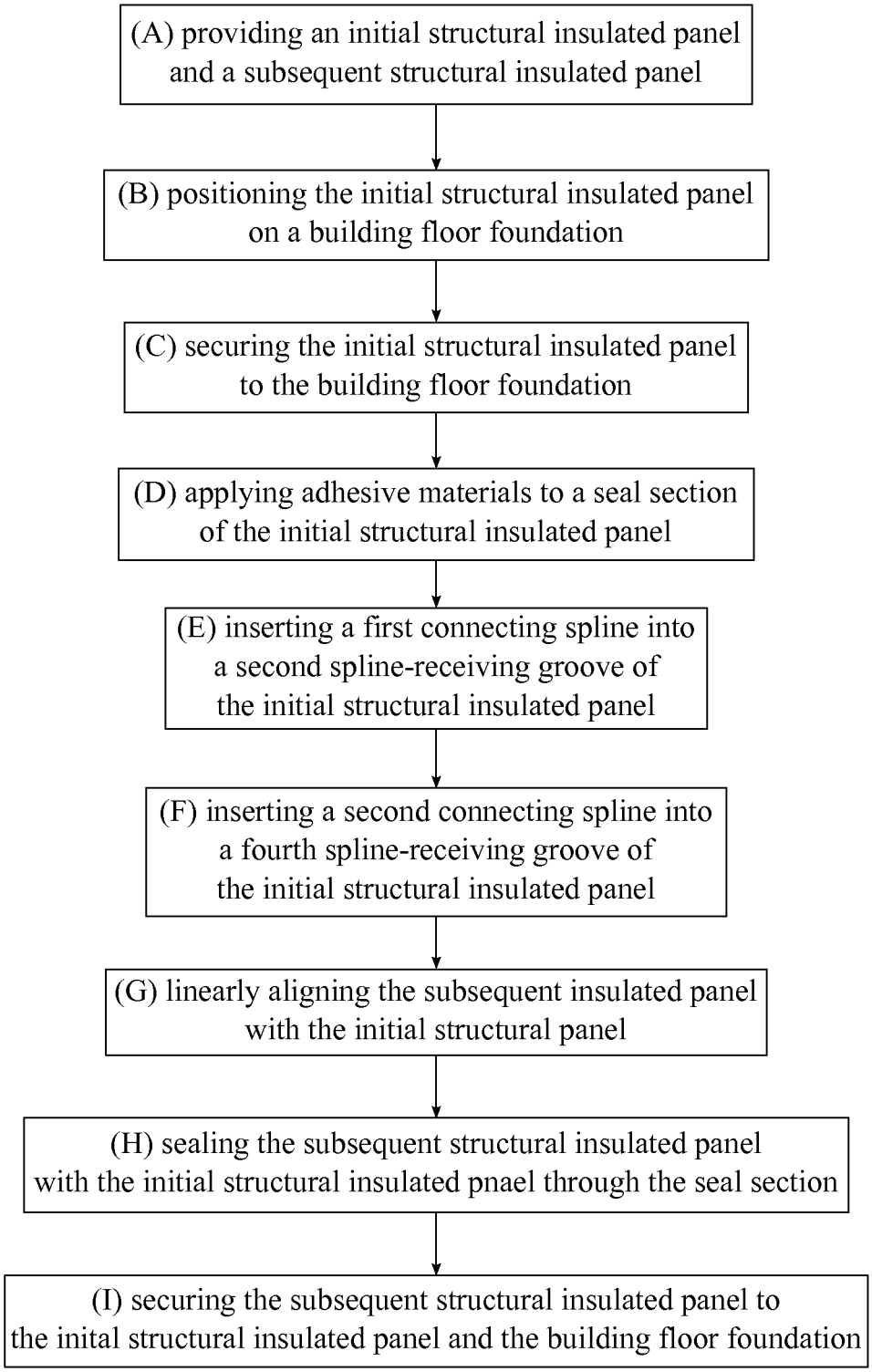
FIG. 7 is a view of a basic flowchart illustrating the overall method of sealing the seal section of the present invention.
Figure 8:
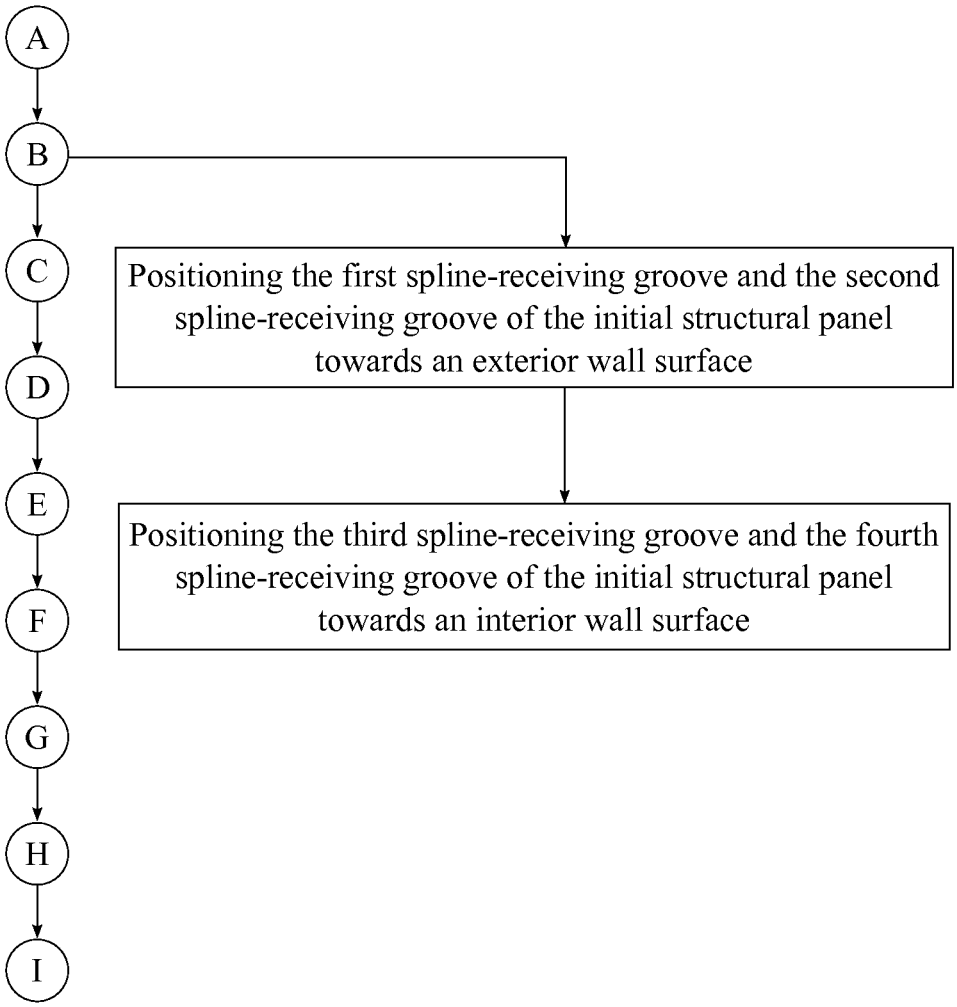
FIG. 8 is a view of a basic flowchart illustrating the positioning of the initial structural insulated panel within the overall method of sealing the seal section of the present invention.
Figure 9:
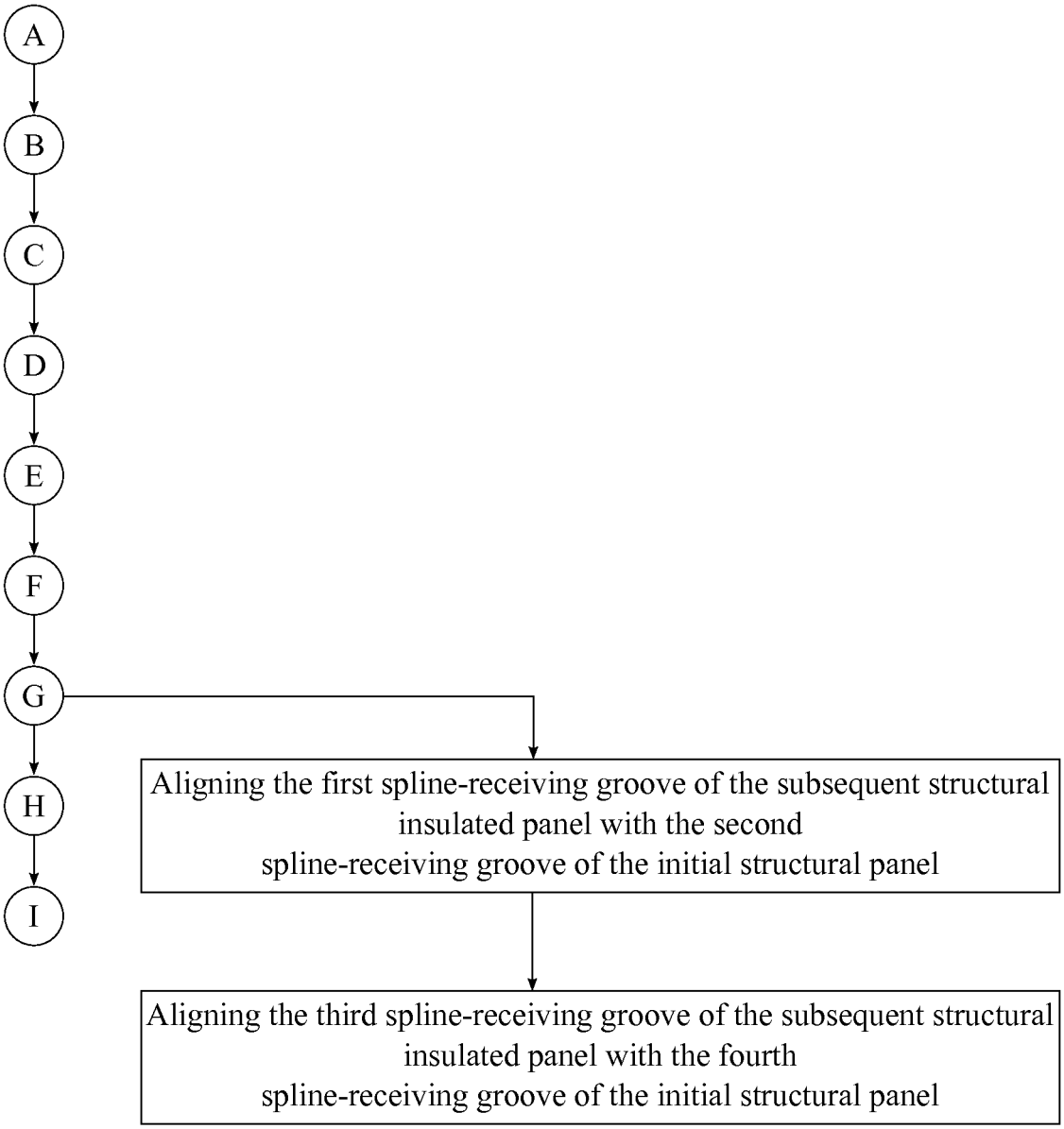
FIG. 9 is a view of a basic flowchart illustrating aligning of the subsequent structural insulated panel within the overall method of sealing the seal section of the present invention.
Figure 10:
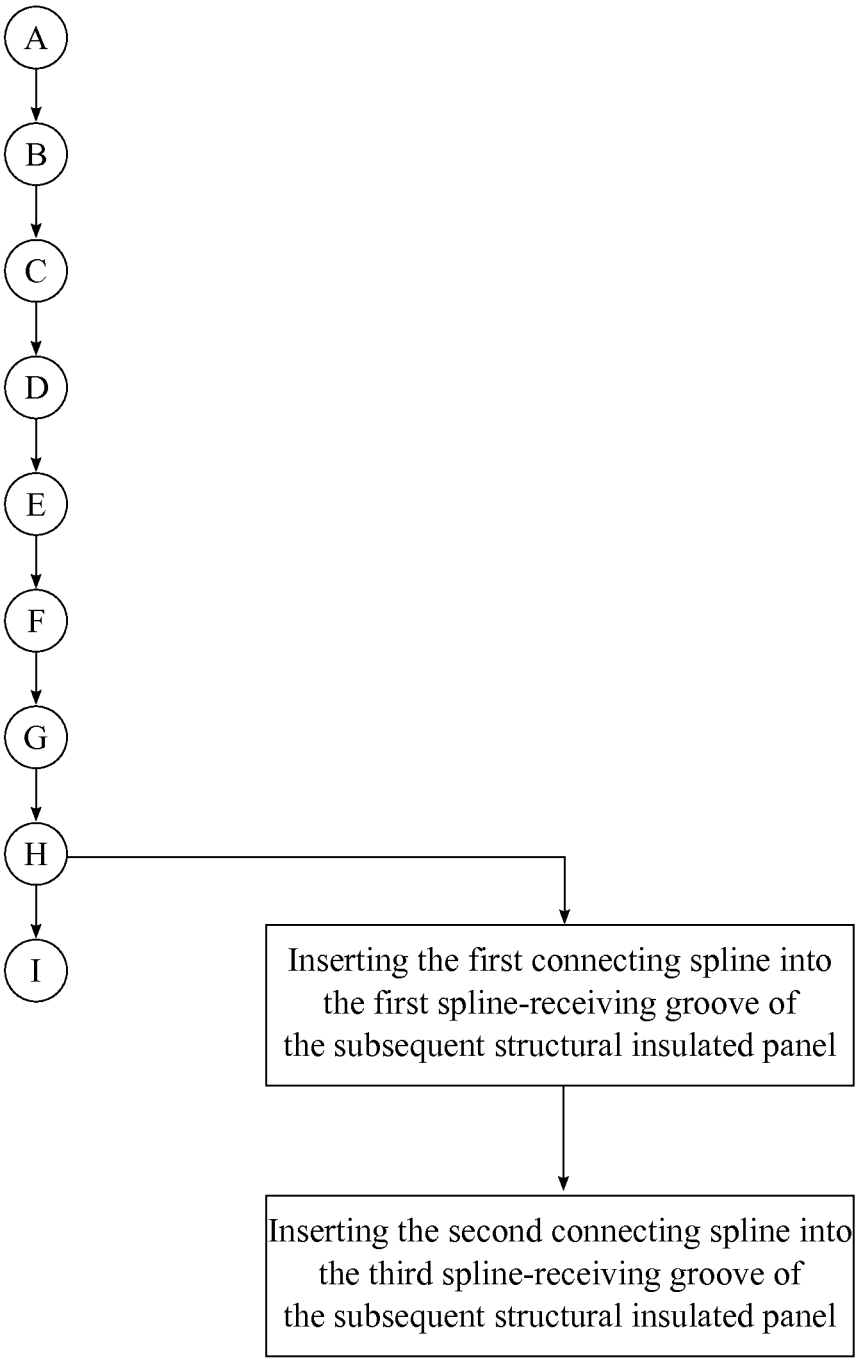
FIG. 10 is a view of a basic flowchart illustrating insertion of the seal section within the overall method of sealing the seal section of the present invention.
Figure 11:
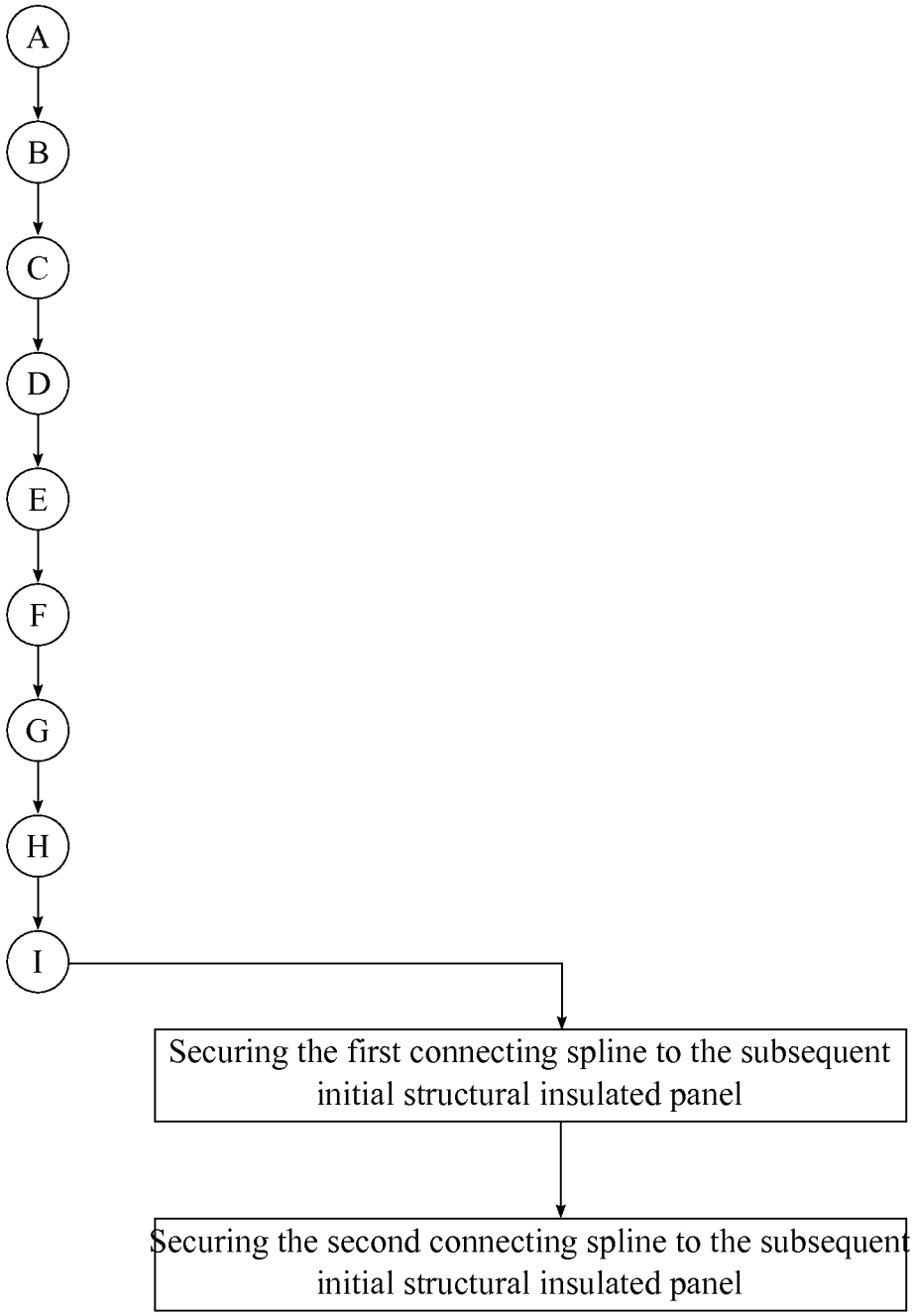
FIG. 11 is a view of a basic flowchart illustrating the securing of the first and second connecting spline within the overall method of sealing the seal section of the present invention.

In reference to FIG. 2, the first spline-receiving groove 3 and the second spline-receiving groove 4 are adjacently positioned with the first edge 15 and the second edge 16 of the present invention. More specifically, the second spline-receiving groove 4 is traversed into the expanded polystyrene layer 13, where the second spline-receiving groove 4 is adjacently positioned with the seal section 2. The first spline-receiving groove 3 is traversed into the expanded polystyrene layer 13, where the first spline-receiving groove 3 is oppositely positioned with the seal section 2. Additionally, the first spline-receiving groove 3 and the second spline-receiving groove 4 are positioned parallel to each other. The structural insulated panel 1 further comprises a third spline-receiving groove 5 and a fourth spline-receiving groove 6, where the third spline-receiving groove 5 and the fourth spline-receiving groove 6 are adjacently positioned with the interior surface board 14. More specifically, the third spline-receiving groove 5 and the fourth spline-receiving groove 6 are traversed into expanded polystyrene layer 13 in such way that the fourth spline-receiving groove 6 is adjacently positioned with the seal section 2 while the third spline-receiving groove 5 is oppositely positioned from the fourth spline-receiving groove 6. The third spline-receiving groove 5 and the fourth spline-receiving groove 6 are positioned parallel to each other, where the first spline-receiving groove 3 and the third spline-receiving groove 5 are coincidentally positioned with each other adjacent to the first edge 15, and the second spline-receiving groove 4 and the fourth spline-receiving groove 6 are coincidentally positioned with each other adjacent to the second edge 16.

A method of sealing the seal section 2 of the present invention is explained in relation to an initial structural insulated panel 7 and a subsequence structural insulated panel 8. In reference to FIG. 5-FIG. 11, the initial structural insulated panel 7 is first positioned on a building floor foundation, where the seal section 2 of the initial structural insulated panel 7 is perpendicularly positioned with the building floor foundation. More specifically, the exterior surface board 11 is positioned as the exterior wall surface, and the interior surface board 14 is positioned as the interior wall surface. As a result, the first spline-receiving groove 3 and the second spline-receiving groove 4 of the initial structural insulated panel 7 position towards the exterior wall surface, and the third spline-receiving groove 5 and the fourth spline-receiving groove 6 of the initial structural insulated panel 7 position towards the interior wall surface. Then the initial structural insulated panel 7 is secured to the building floor foundation by adhesive materials and a plurality of fastener. After the initial structural insulated panel 7 is secured, more adhesive materials are applied to the seal section 2 of the initial structural insulated panel 7. Then a first connecting spline is inserted into the second spline-receiving groove 4 of the initial structural insulated panel 7, and a second connecting spline is inserted into the fourth spline-receiving groove 6 of the initial structural insulated panel 7. The subsequence structural insulated panel 8 is then linearly aligned with the initial structural insulated panel 7 along the building floor foundation. More specifically, the first spline-receiving groove 3 of the subsequence structural insulated panel 8 is aligned with the second spline-receiving groove 4 of the initial structural insulated panel 7, and the third spline-receiving groove 5 of the subsequence structural insulated panel 8 is aligned with the fourth spline-receiving groove 6 of the initial structural insulated panel 7. Then the subsequence structural insulated panel 8 and the initial structural insulated panel 7 are sealed together by the seal section 2. More specifically, the seal section 2 of the initial structural insulated panel 7 is inserted into the first spline-receiving groove 3 of the subsequence structural insulated panel 8 so that the seal section 2 of the initial structural insulated panel 7 can be sealed with the first spline-receiving groove 3 of the subsequence structural insulated panel 8. Simultaneously, the first spline-receiving groove 3 of the subsequence structural insulated panel 8 is inserted into the first connecting spline, and the third spline-receiving groove 5 of the subsequence structural insulated panel 8 is inserted into the second connecting spline. The insertion of the first connecting spline secures the subsequence structural insulated panel 8 with the initial structural insulated panel 7 adjacent to the exterior surface board 11. Since the first connecting spline is adjacently positioned with the seal section 2 of the initial structural insulated panel 7 opposite of the exterior surface boards 11, and the seal section 2 is inserted within the first spline-receiving groove 3 of the subsequence structural insulated panel 8, the seal section 2 gets compress in between the first connecting spline and the exterior surface board 11 of the subsequence structural insulated panel 8. Then the seal section 2 creates a moisture barrier in between the initial structural insulated panel 7 and the subsequence structural insulated panel 8 of the building envelope system in order to minimize the thermal break in between the initial structural insulated panel 7 and the subsequence structural insulated panel 8. The insertion of the second connecting spline secures the subsequence structural insulated panel 8 with the initial structural insulated panel 7 adjacent to the interior surface board 14. In both instances, a plurality of fasteners is used to connect the subsequence structural insulated panel 8 with the initial structural insulated panel 7. More specifically, the plurality of fasteners is externally traversed through the exterior surface boards 11 and the phenolic resin sheet 12 and into the first connecting spline so that the subsequence structural insulated panel 8 and the initial structural insulated panel 7 can be attached to each other through the first connecting spline from the exterior side of the structural building. Similarly, the plurality of fasteners is externally traversed through the interior surface boards 14 and into the second connecting spline so that the subsequence structural insulated panel 8 and the initial structural insulated panel 7 can be attached to each other through the second connecting spline from the interior side of the structural building. As the final step, the subsequence structural insulated panel 8 and the initial structural insulated panel 7 are secured to the building floor foundation by the plurality of fasteners.

Although the invention has been explained in relation to its preferred embodiment, it is to be understood that many other possible modifications and variations can be made without departing from the spirit and scope of the invention as hereinafter claimed.

What is claimed is:

1. A structural insulated building panel with a moisture barrier seal comprises:

a structural insulated panel;

a seal section;

a first spline-receiving groove;

a second spline-receiving groove;

the seal section being extended from a phenolic resin sheet of the structural insulated panel;

the first spline-receiving groove traversing into the structural insulated panel adjacent to the phenolic resin sheet;

the second spline-receiving groove traversing into the structural insulated panel adjacent to the phenolic resin sheet;

the first spline-receiving groove and the second spline-receiving groove being oppositely positioned across the structural insulated panel;

the structural insulated panel further comprises an exterior surface board, an expanded polystyrene layer, and an interior surface board;

the exterior surface board, the phenolic resin sheet, the expanded polystyrene layer, and the interior surface board each comprise a first edge and a second edge;

the first edge of the exterior surface board, the phenolic resin sheet, the expanded polystyrene layer, and the interior surface board being oppositely positioned from the second edge of the exterior surface board, the phenolic resin sheet, the expanded polystyrene layer, and the interior surface board;

the first edge of the exterior surface board, the phenolic resin sheet, the expanded polystyrene layer, and the interior surface board being coincident with each other;

the second edge of the exterior surface board, the expanded polystyrene layer, and the interior surface board being coincident with each other; and the second edge of the phenolic resin sheet being extended from the second edge of the exterior surface board, the expanded polystyrene layer, and the interior surface board in order to form the seal section.

2. The structural insulated building panel with a moisture barrier seal as claimed in claim 1 comprises:

the phenolic resin sheet being adjacently connected with the expanded polystyrene layer;

the exterior surface board being adjacently connected to the phenolic resin sheet opposite from the expanded polystyrene layer; and the interior surface board being adjacently connected to the expanded polystyrene layer opposite from the phenolic resin sheet.

3. The structural insulated building panel with a moisture barrier seal as claimed in claim 2, wherein the exterior surface board and the interior surface board being a pair of magnesium oxide boards.

4. The structural insulated building panel with a moisture barrier seal as claimed in claim 1 comprises:

the structural insulated panel further comprises an exterior surface board, an expanded polystyrene layer, and an interior surface board;

the second spline-receiving groove traversing into the expanded polystyrene layer;

the second spline-receiving groove being adjacently positioned with the seal section;

the first spline-receiving groove traversing into the expanded polystyrene layer;

the first spline-receiving groove being oppositely positioned from the seal section; and the first spline-receiving groove and the second spline-receiving groove being positioned parallel to each other.

5. The structural insulated building panel with a moisture barrier seal as claimed in claim 1 comprises:

the structural insulated panel further comprises an exterior surface board, an expanded polystyrene layer, and an interior surface board;

a third spline-receiving groove;

a fourth spline-receiving groove;

the fourth spline-receiving groove traversing into the expanded polystyrene layer;

the fourth spline-receiving groove being adjacently positioned with the interior surface board and the seal section;

the third spline-receiving groove traversing into the expanded polystyrene layer;

the third spline-receiving groove being adjacently positioned with the interior surface board opposite of the fourth spline-receiving groove; and the third spline-receiving groove and the fourth spline-receiving groove being positioned parallel to each other.

6. A structural insulated building panel with a moisture barrier seal comprises:

a structural insulated panel;

a seal section;

a first spline-receiving groove;

a second spline-receiving groove;

the structural insulated panel further comprises an exterior surface board, a phenolic resin sheet, an expanded polystyrene layer, and an interior surface board;

the exterior surface board, the phenolic resin sheet, the expanded polystyrene layer, and the interior surface board each comprise a first edge and a second edge;

the first edge of the exterior surface board, the phenolic resin sheet, the expanded polystyrene layer, and the interior surface board being oppositely positioned from the second edge of the exterior surface board, the phenolic resin sheet, the expanded polystyrene layer, and the interior surface board;

the first edge of the exterior surface board, the phenolic resin sheet, the expanded polystyrene layer, and the interior surface board being coincident with each other;

the second edge of the exterior surface board, the expanded polystyrene layer, and the interior surface board being coincident with each other;

the second edge of the phenolic resin sheet being extended from the second edge of the exterior surface board, the expanded polystyrene layer, and the interior surface board in order to form the seal section;

the first spline-receiving groove traversing into the structural insulated panel adjacent to the phenolic resin sheet;

the second spline-receiving groove traversing into the structural insulated panel adjacent to the phenolic resin sheet; and the first spline-receiving groove and the second spline-receiving groove being oppositely positioned across the structural insulated panel.

7. The structural insulated building panel with a moisture barrier seal as claimed in claim 6 comprises:

the structural insulated panel further comprises an exterior surface board, an expanded polystyrene layer, and an interior surface board;

the phenolic resin sheet being adjacently connected with the expanded polystyrene layer;

the exterior surface board being adjacently connected to the phenolic resin sheet opposite from the expanded polystyrene layer; and the interior surface board being adjacently connected to the expanded polystyrene layer opposite from the phenolic resin sheet.

8. The structural insulated building panel with a moisture barrier seal as claimed in claim 7, wherein the exterior surface board and the interior surface board being a pair of magnesium oxide boards.

9. The structural insulated building panel with a moisture barrier seal as claimed in claim 6 comprises:

the second spline-receiving groove traversing into the expanded polystyrene layer;

the second spline-receiving groove being adjacently positioned with the seal section;

the first spline-receiving groove traversing into the expanded polystyrene layer;

the first spline-receiving groove being oppositely positioned from the seal section; and the first spline-receiving groove and the second spline-receiving groove being positioned parallel to each other.

10. The structural insulated building panel with a moisture barrier seal as claimed in claim 6 comprises:

a third spline-receiving groove;

a fourth spline-receiving groove;

the fourth spline-receiving groove traversing into the expanded polystyrene layer;

the fourth spline-receiving groove being adjacently positioned with the interior surface board and the seal section;

the third spline-receiving groove traversing into the expanded polystyrene layer;

the third spline-receiving groove being adjacently positioned with the interior surface board opposite of the fourth spline-receiving groove; and the third spline-receiving groove and the fourth spline-receiving groove being positioned parallel to each other.

11. A method of sealing the seal section of the structural insulated building panel as claimed in claim 1 comprises the steps in combination of:

(A) providing an initial structural insulated panel and a subsequent structural insulated panel, wherein the initial structural insulated panel and the subsequent structural insulated panel each comprise a seal section, a first spline-receiving groove, a second spline-receiving groove, a third spline-receiving groove, and a fourth spline-receiving groove;

(B) positioning the initial structural insulated panel on a building floor foundation, wherein the seal section the initial structural insulated panel is perpendicularly positioned with the building floor foundation;

(C) securing the initial structural insulated panel to the building floor foundation;

(D) applying adhesive materials to the seal section of the initial structural insulated panel;

(E) inserting a first connecting spline into the second spline-receiving groove of the initial structural insulated panel;

(F) inserting a second connecting spline into the fourth spline-receiving groove of the initial structural insulated panel;

(G) linearly aligning the subsequent structural insulated panel with the initial structural insulated panel along the building floor foundation;

(H) sealing the subsequent structural insulated panel with the initial structural insulated panel through the seal section; and (I) securing the subsequent structural insulated panel to the initial structural insulated panel and the building floor foundation.

12. The method of sealing the seal section of structural insulated building panel as claimed in claim 11 comprises the steps in combination of:

positioning the first spline-receiving groove and the second spline-receiving groove of the initial structural insulated panel towards an exterior wall surface; and positioning the third spline-receiving groove and the fourth spline-receiving groove of the initial structural insulated panel towards an interior wall surface.

13. The method of sealing the seal section of the structural insulated building panel as claimed in claim 11 comprises the steps in combination of:

aligning the first spline-receiving groove of the subsequent structural insulated panel with the second spline-receiving groove of the initial structural insulated panel; and aligning the third spline-receiving groove of the subsequent structural insulated panel with the fourth spline-receiving groove of the initial structural insulated panel.

14. The method of sealing the seal section of the structural insulated building panel as claimed in claim 11 comprises the steps in combination of:

inserting the seal section of the initial structural insulated panel into the first spline-receiving groove of the subsequent structural insulated panel;

inserting the first spline-receiving groove of the subsequent structural insulated panel into the first connecting spline, wherein the first connecting spline seals the seal section into the first spline-receiving groove of the subsequent structural insulated panel in order to create a moisture barrier in between the initial structural insulated panel and the subsequent structural insulated panel; and inserting the third spline-receiving groove of the subsequent structural insulated panel into the second connecting spline.

15. The method of sealing the seal section of the structural insulated building panel as claimed in claim 11 comprises the steps in combination of:

securing the first connecting spline to the subsequent structural insulated panel and the initial structural insulated panel; and securing the second connecting spline to the subsequent structural insulated panel and the initial structural insulated panel.

* * * * *